US006938684B2

(12) United States Patent
Iwasaki

(10) Patent No.: US 6,938,684 B2
(45) Date of Patent: Sep. 6, 2005

(54) CORRUGATED FIN

(75) Inventor: Mitsuru Iwasaki, Nakano-ku (JP)

(73) Assignee: Calsonic Kansei Corporation, Tokyo (JP)

( * ) Notice: Subject to any disclaimer, the term of this patent is extended or adjusted under 35 U.S.C. 154(b) by 0 days.

(21) Appl. No.: 10/690,546

(22) Filed: Oct. 23, 2003

(65) Prior Publication Data

US 2004/0112578 A1 Jun. 17, 2004

(30) Foreign Application Priority Data

Oct. 24, 2002 (JP) ..... 2002-309952

(51) Int. Cl.[7] ..... F28F 13/08
(52) U.S. Cl. ..... 165/135; 165/140; 29/890.03
(58) Field of Search ..... 165/135, 140; 29/890.03

(56) References Cited

U.S. PATENT DOCUMENTS 6,170,565 B1 * 1/2001 Nishishita ..... 165/140
6,209,628 B1 * 4/2001 Sugimoto et al. ..... 165/140
6,213,196 B1 4/2001 Ozaki et al. ..... 165/140
6,273,184 B1 * 8/2001 Nishishita ..... 165/140
6,308,527 B1 10/2001 Kuroyanagi et al. ..... 62/288
6,357,518 B1 * 3/2002 Sugimoto et al. ..... 165/140
6,408,939 B1 * 6/2002 Sugimoto et al. ..... 165/140
2001/0022220 A1 * 9/2001 Ozaki et al. ..... 165/135
2002/0020519 A1 * 2/2002 Martins et al. ..... 165/140

FOREIGN PATENT DOCUMENTS

EP 0881450 B1 12/1998
JP 2003-83690 3/2003

* cited by examiner

*Primary Examiner*—Teresa J. Walberg
(74) *Attorney, Agent, or Firm*—Wenderoth, Lind & Ponack, L.L.P.

(57) ABSTRACT

A corrugated fin for a composite heat exchanger for motor vehicles includes a condenser portion and a radiator portion. The radiator portion is larger in fin width than the condenser portion. The condenser portion and the radiator portion respectively have first and second louvers formed corresponding to the fin widths. The first and second louvers respectively have first and second louver slats inclined in a direction which is different for each of the condenser portion and the radiator portion so as to oppose each other, and an inclination angle of the second louver slats is smaller than an inclination angle of the first louver slats.

20 Claims, 6 Drawing Sheets

CORRUGATED FIN

BACKGROUND OF THE INVENTION

1. Field of the Invention

The present invention belongs to a technical field of a corrugated fin for composite heat exchangers.

2. Description of the Related Art

A conventional corrugated fin corresponds to required heat release amounts of respective heat exchangers by making a fin width and a number of louver slats different between a condenser side and a radiator side. (For example, refer to Japanese Patent Laid-open No. Hei 10-253276.)

Regarding composite heat exchangers used particularly for motor vehicles, there has been a demand to make thicknesses of a condenser and a radiator, which compose a composite heat exchanger, different according to diversification of size of cabin and diversification of required specification of cooling performance in an engine room. In this case, a corrugated fin should be made to have a different fin width between the condenser side and the radiator side. However, the conventional corrugated fin has such a problem in that, when the fin widths of the corrugated fin integrally formed with the corrugated fin of the composite heat exchanger are made different from each other, an entire corrugated fin bend during a corrugating step due to a difference of residual stresses generated during a louver processing step due to a difference of number of louver slats is formed according to the fin width.

SUMMARY OF THE INVENTION

An object of the present invention is to provide a corrugated fin which integrally has two types of fin widths respectively made different corresponding to two types of heat exchangers, with the corrugated fin being capable of preventing bending of the corrugated fin in its entirety during a corrugating step thereof due to a residual stress generated during a louver processing step.

Another object of the present invention is to provide a manufacturing method for a corrugated fin which integrally has two types of fin widths respectively made different corresponding to two types of heat exchangers, with the corrugated fin being capable of preventing bending of the corrugated fin in its entirety during a corrugating step thereof due to a residual stress generated during a louver processing step.

In order to achieve the first object, the corrugated fin according to the present invention comprises: first and second corrugated fin portions having different fin widths corresponding to two types of heat exchangers and integrally formed next to each other, with the fin width (LA) of the first corrugated fin portion being smaller than the fin width of the second corrugated fin portion; and first and second louvers provided on each of the first and second corrugated fin portions to extend corresponding to the fin widths of the first and second corrugated fin portions, with the first and second louvers respectively having a plurality of louver slats inclined at a predetermined angle, with the louver slats respectively having a direction of inclination which is different between each of the first and second corrugated fin portions, and with a processed amount per unit width of the second louver being smaller than a processed amount per unit width of the first louver.

On the corrugated fin, residual stress per unit width generated during a louver processing step is reduced by making a processed amount per unit width of the second louver on the second corrugated fin portion smaller than a processed amount per unit width of the first louver on the first corrugated fin portion. Accordingly, a degree of intensity of the residual stress becomes low, and a combination of the larger fin width and the louver having more louver slats with residual stress of small intensity can be substantially balanced with a combination of the smaller fin width and the louver having less louver slats with residual stress of large intensity, thereby preventing bending of the entire corrugated fin during a processing step thereafter.

Thus, the two types of corrugated fin portions can be made to have different fin widths to thereby meet diversified demands for performance.

In the above corrugated fin, an inclination angle of the second louver on the second corrugated fin portion is preferably smaller than an inclination angle of the first louver on the first corrugated fin portion so that the processed amount per unit width of the second louver becomes smaller than that of the first louver.

This results in that the combination of the larger fin width and the second louver having more louver slats with the residual stress of small intensity can be substantially balanced with the combination of the smaller fin width and the first louver having less louver slats with the residual stress of large intensity, thereby preventing bending of the entire corrugated fin during the processing step thereafter.

Since the second louver on the second corrugated fin portion has the smaller inclination angle, excellent cooling performance can be obtained due to smooth air flow, even though the louver has a large number of louver slats.

Thus, the two types of corrugated fin portions can be made to have different fin widths to thereby meet diversified demands for performance and improve heat exchange performance.

Further, in the above corrugated fin, a pitch between adjacent louver slats of the second louver formed on the second corrugated fin portion is preferably narrower than a pitch between adjacent louver slats of the first louver formed on the first corrugated fin portion, so that the processed amount per unit width of the second louver becomes smaller than that of the first louver.

This results in that the combination of the larger fin width and the second louver having more louver slats with the residual stress of small intensity can be substantially balanced with the combination of the smaller fin width and the first louver having less louver slats with the residual stress of large intensity, thereby preventing bending of the entire corrugated fin during the processing step thereafter.

Further, in the above corrugated fin, the second louver of the second corrugated fin having the larger fin width has an increased heat release area to contact with air flow, so that excellent cooling performance can be obtained.

Thus, the two types of corrugated fin portions can be made to have different fin widths to thereby meet diversified demands for performance and improve heat exchange performance.

Further, on the corrugated fin, the first corrugated fin portion is preferably for automotive condensers, and the second corrugated fin portion is preferably for automotive radiators.

This results in that fin widths of a condenser portion and a radiator portion of the composite heat exchanger can correspond to respective demands for cooling performance and to diversified motor vehicles while reducing cost.

In order to achieve the second object, the manufacturing method of the corrugated fin according to the present invention comprises: a louver processing step to form first and second louvers in such a manner that on each of first and second corrugated fin portions there are respectively different fin widths corresponding to two types of heat exchangers and integrally formed next to each other, with the fin width of the first corrugated fin portion being smaller than the fin width of the second corrugated fin portion, with the first and second louvers extending corresponding to the fin widths of the first and second corrugated fin portions and having a plurality of louver slats inclined at a predetermined angle respectively, with the louver slats respectively having a direction of inclination which is different between each of the first and second corrugated fin portions, and with a processed amount per unit width of the second corrugated fin portion being smaller than a processed amount per unit width of the first corrugated fin portion; and a bend correcting step to correct, after the louver processing step, a bend of an entire body of the first and second corrugated fin portions by widening to a predetermined width a wave pitch inside a bending direction of the first and second corrugated fin portions which are formed entirely in a corrugated form During the manufacturing method of the corrugated fin, when two types of corrugated fin portions having different fin widths are corrugated to form the corrugated fin, a bend of the corrugated fin is corrected by widening to the predetermined width the wave pitch inside the bending direction of the corrugated fin which tends to bend entirely when corrugated. Accordingly, bends can be further corrected and minimized, and the two types of the corrugated fin portions can have different fin widths, thereby meeting diversified demands for performance.

DETAILED DESCRIPTION OF THE PREFERRED EMBODIMENTS

Hereinafter, embodiments for realizing a corrugated fin of the present invention will be described based on the drawings.

First Embodiment

First, a structure will be explained.

Figure 1:
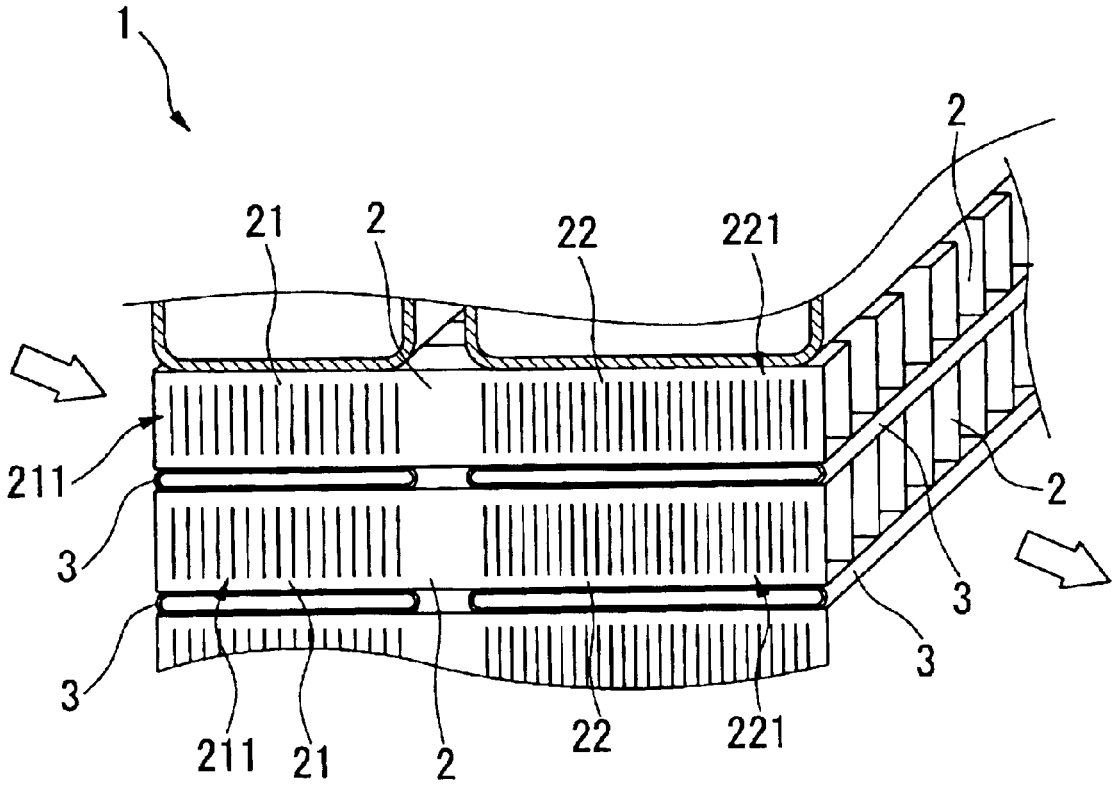
FIG. 1 is an explanatory view showing a part of a composite heat exchanger using corrugated fins of a first embodiment.
Figure 2:
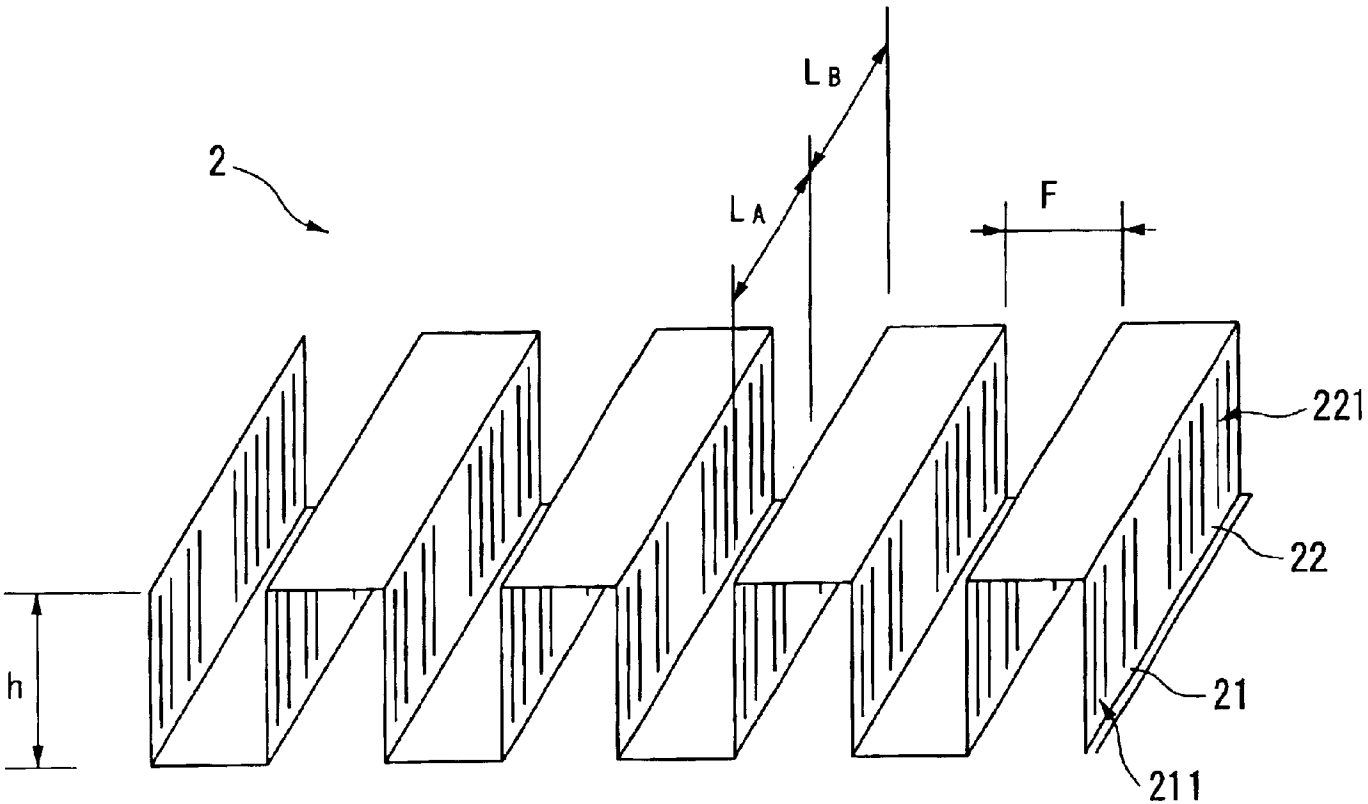
FIG. 2 is an enlarged view of the corrugated fins of the first embodiment.
Figure 3:
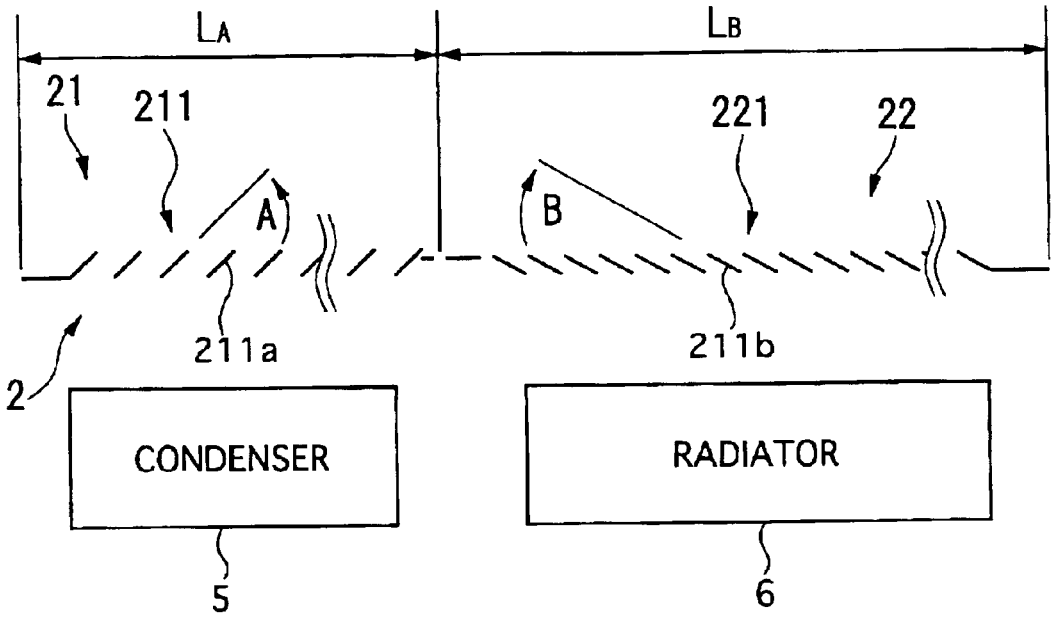
FIG. 3 is a schematic view showing a cross-section of the corrugated fins of the first embodiment.

FIG. 1 is an explanatory view showing a part of a composite heat exchanger using a corrugated fin of a first embodiment. FIG. 2 is an enlarged view of the corrugated fin of the first embodiment. FIG. 3 is a schematic view showing a cross-section of the corrugated fin of the first embodiment.

As shown in FIG. 1 to FIG. 3, a composite heat exchanger 1 includes plural corrugated fins 2 respectively having a condenser portion 21 and a radiator portion 22, and tubes 3 arranged between these corrugated fins 2.

The first embodiment is an example of the corrugated fins 2 which are used for the composite heat exchanger 1, which comprises a condenser 5 and a radiator 6 arranged in a parallel relationship with each other and mounted in a motor vehicle.

Each corrugated fin 2 is, as shown in FIG. 2, integrally formed of the condenser portion 21, corresponding to a first corrugated fin portion of the present invention and used as a corrugated fin of the condenser 5, and the radiator portion 22, corresponding to a second corrugated fin portion of the present invention and used as a corrugated fin of the radiator 6.

Further, in FIG. 2, for the corrugated fin 2, a fin width of the condenser portion 21 is denoted by LA, a fin width of the radiator portion 22 is denoted by LB, a wave pitch is denoted by F, and a wave height is denoted by h. The fin width LB of the radiator portion 22 is larger than the fin width LA of the condenser portion 21.

The corrugated fin 2, with the condenser portion 21 and the radiator portion 22, is formed based on a long plate on which, first, a first louver 211 is formed at a predetermined pitch on a condenser portion of the long plate. The first louver 211 has a plurality of louver slats 211*a* formed by opening and raising a portion of the long plate corresponding to the fin width LA of the condenser portion 21, with the louver slats 211 a being processed so as to be inclined relative to the long plate at a predetermined inclination angle A.

In the first embodiment, the number of louver slats 211*a* of the first louver 211 formed on the condenser portion of the long plate is sixteen, and the inclination angle A of the first louver slats 211*a* is 23°.

Meanwhile, a second louver 221 is formed at a predetermined pitch on a radiator portion of the long plate. The second louver 221 is formed by a plurality of louver slats 221*a* corresponding to the fin width LB of the radiator portion 22, with the louver slats being processed so as to be inclined relative to the long plate at a predetermined inclination angle B.

In the first embodiment, the number of louver slats 221*a* of the second louver 221 formed on the radiator portion of the long plate is twenty-seven, and the inclination angle B of the second louver slats 221*a* is 20°.

Further, the first and second louver slats 211*a* and 221*a* of the first and second louvers 211 and 221 are inclined in different directions which oppose each other.

The plate on which the first and second louvers 211 and 221 are formed is corrugated by processing to thereby form the corrugated fin 2. Then, plural layers of these corrugated fins 2 are arranged between the tubes 3 to compose the composite heat exchanger 1.

Here, in manufacturing the corrugated fin 2, prevention of bending of the corrugated fin 2 during formation of the corrugated fin 2 is, if necessary, performed as follows.

The first and second louvers 211 and 221 formed on the condenser portion and the radiator portion of the long plate respectively have the different number of louver slats 211*a* and 221*a* to be sixteen and twenty-seven, which causes different residual stresses to remain at processed portions and in the vicinity thereof during processing of forming the louver slats 211*a* and 221*a* by opening and rising a corresponding portion of the long plate. However, on the corrugated fin 2 in the first embodiment, the second louver slats

221*a* of the second louver 221 of the radiator portion of the long plate, which are formed to be as many as twenty-seven, have a small inclination angle of 20° so as to make a processed amount of raising the second louver slats 221*a* smaller than that of the first louver slats 211*a* of the first louver 211 of the condenser portion of the long plate. The intensity of residual stress per unit width is thus adjusted so that sums of respective residual stresses of the condenser portion and the radiator portion become approximately equal. This adjustment to the inclination angles of the first and second louver slats 211*a* and 221*a* can prevent bending of an entire corrugated fin 2 during the above mentioned corrugating process thereafter.

Figure 4:
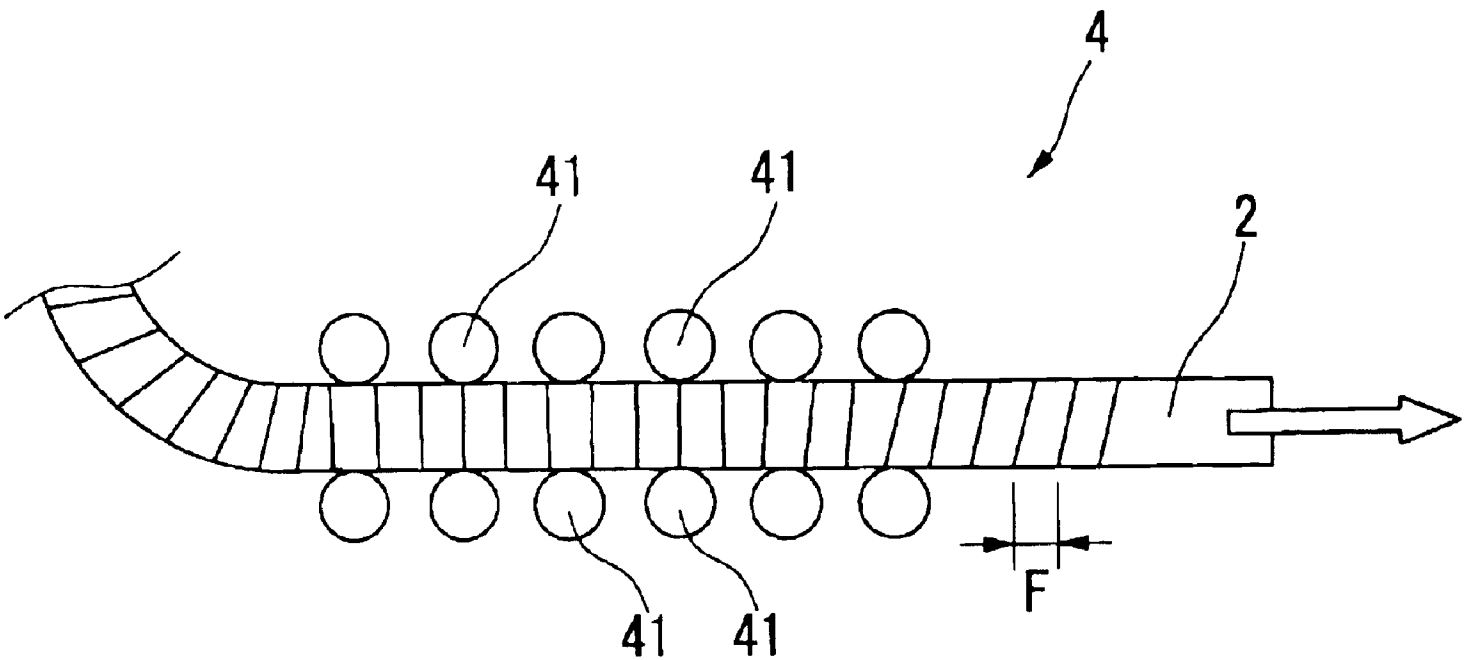
FIG. 4 is an explanatory view showing a corrugated fin correcting device used for manufacturing the corrugated fins of the first embodiment.

After this louver processing step, as shown in FIG. 4, the corrugated fin 2 of the first embodiment is passed through between rollers 41 of a corrugated fin correcting device 4, which has plural rollers 41 at a predetermined pitch. Consequently, corrugated fins 2 are obtained with high precision of linearity and the fin pitch is made to be a predetermined width so that each corrugated fin 2 can be precisely assembled to form the composite heat exchanger 1 thereafter.

On this thus formed corrugated fin 2, the inclination angle B of the second louver 221 of the radiator portion 22 is small so air flows smoothly even when the fin width LB of the radiator portion 22 is made larger, and thus a cooling performance can be improved without impairing an effect of making the fin width LB larger.

The corrugated fin 2 of the first embodiment can provide effects as listed below.

(1) The radiator portion 22 and the condenser portion 21 of first and second corrugated fins 2, having two different fin widths, of a composite heat exchanger 1 for motor vehicles are formed integrally next to each other. The first and second louver slats 211*a* and 221*a* are formed by performing an opening and rising process to have numbers of sixteen and twenty-seven, respectively, corresponding to the fin widths LA and LB on the condenser portion 21 and the radiator portion 22, the first louver slats 211*a* of the condenser portion 21 is made to be inclined at an inclination angle of 23°, the second louver slats 221*a* of the radiator portion 22 is made to be inclined at an inclination angle of 20°, and inclination directions of the first and second louver slats 211*a* and 221*a* are made different opposing each other. Bending of the entire corrugated fin 2 is prevented by making a processed amount per unit width of the second louver 221 on the radiator portion 22, having the larger fin width, smaller than a processed amount per unit width of the first louver 211 on the first condenser portion 21, having the smaller fin width. Consequently, the two portions 21 and 22 of the corrugated fin 2 can have the different fin widths LA and LB to thereby meet diversified demands for performance.

(2) On the condenser portion 21 and the radiator portion 22 having two different fin widths of the composite heat exchanger 1 for motor vehicles, the condenser portion 21 is inclined at the angle of 23° and the radiator portion 22 is inclined at the angle of 20°, and the angle of the second louver slats 221*a* of the radiator portion 22 having the larger fin width LB is made smaller than the angle of the first louver slats 211*a* of the condenser portion 22 having the smaller fin width LA, so that the two portions 21 and 22 are made to have inclination angles corresponding to the different fin widths LA and LB, thereby meeting diversified demands for performance and improving heat exchange performance.

(4) For the condenser portion 21 of the corrugated fin 2 used for automotive condensers and the radiator portion 22 of the corrugated fin 2 used for automotive radiators, the inclination angles of the first and second louver slats 211*a* and 221*a* are set corresponding to the fin widths LA and LB for the condenser 5 and the radiator 6 of the composite heat exchanger 1, thereby corresponding to respective demands for cooling performance and to diversified motor vehicles while reducing cost.

Second Embodiment

Figure 5:
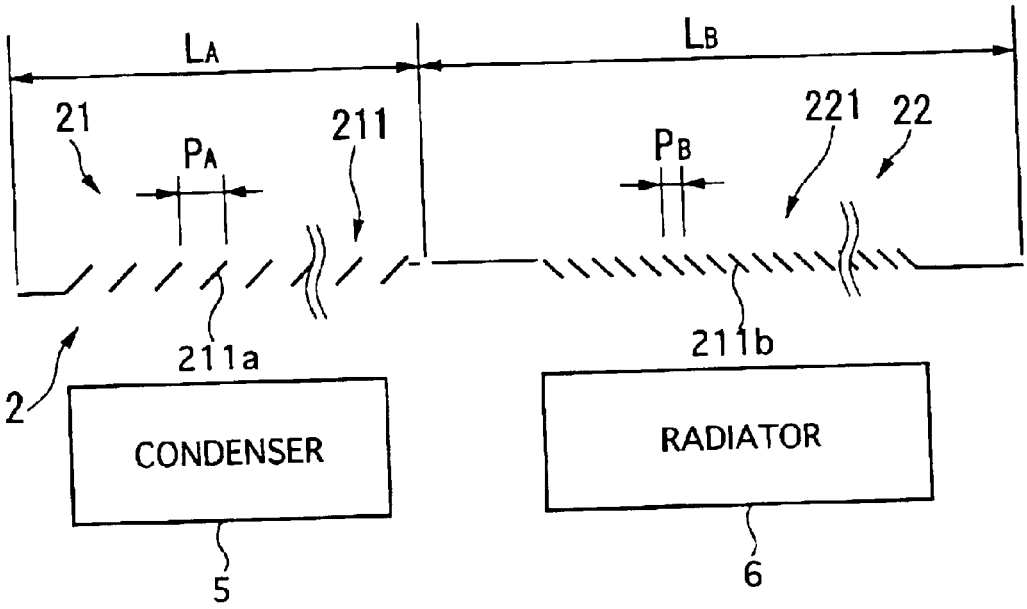
FIG. 5 is a cross-sectional explanatory view of a corrugated fin of a second embodiment.

In a second embodiment, as shown in FIG. 5, a condenser portion 21 corresponding to a first corrugated fin portion of the present invention has a fin width PA smaller than a fin width PB of a radiator portion 22 corresponding to a second corrugated fin portion of the present invention. The condenser portion 21 and the radiator portion 22 have first and second louvers 21 and 22, respectively. The first and second louvers 21 and 22 are formed with first and second louver slats 211*a* and 22 la, respectively. A pitch PB of the second louver slats 221*a* of the second louver 221 of the radiator portion 22 is smaller than a pitch PA of first louver slats 211*a* of the first louver 21 of the condenser portion 21.

Incidentally, other structure is the same as that of the corrugated fins 2 of the first embodiment, so an explanation thereof is omitted.

Here, prevention of bending of the corrugated fins 2 during formation of the corrugated fin 2 is, if necessary performed as follows.

By narrowing the pitch PB of the second louver slats 221*a* of the radiator portion 22 relative to the pitch PA of the condenser portion 21, the corrugated fin 2 of the second embodiment reduces a processed amount of raising the second louver slats 221*a* to a predetermined inclination angle when forming the second louver 221 so as to equalize intensity of residual stress per unit width on the radiator portion 22, with intensity of residual stress per unit width remaining on the condenser portion 21, thereby preventing bending of the corrugated fin 2 during a corrugating step thereafter.

The corrugated fin 2 of the second embodiment can provide the following effects in addition to the effects (1) and (4) of the first embodiment.

(3) By narrowing the pitch PB between each second louver slat 221*a* of the second louver 221 of the radiator portion 22 having the fin width LB more than the fin width PA of the first louver slats 211*a* of the condenser portion 21, the two portions 21 and 22 of corrugated fin 2 can have different fin widths, thereby meeting diversified demands for performance.

Incidentally, a manufacturing method of the corrugated fin 2 to correct a bend of an entire corrugated fin 2 thereafter will be explained.

Figure 6A:
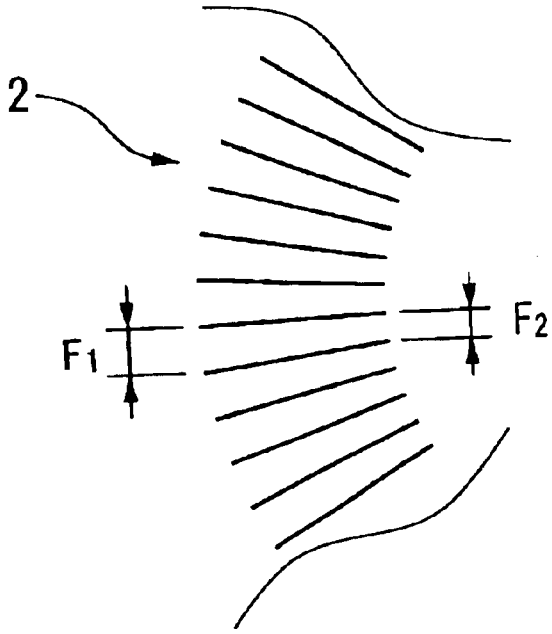
FIGS. 6A and 6B are explanatory views of a manufacturing method for the corrugated fin according to the present invention.
Figure 6B:
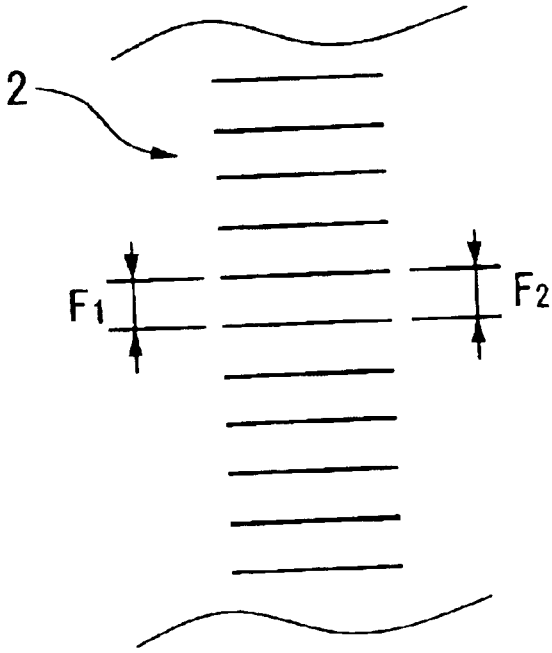

When forming the corrugated fin 2, a bend of the entire corrugated fin 2 generated during corrugating processing is thereafter corrected using a corrugated fin correcting device 4 shown in FIG. 4 in such a manner that when the corrugated fin 2 is passed through between rollers 41 which are arranged at a predetermined pitch and opposing each other, a circumferential speed of a roller inside a bending direction (a pitch F2 side shown in FIG. 6A) is made to be faster than that of an opposing side (a pitch F1 side shown in FIG. 6A). Consequently, as shown in FIG. 6B, a pitch F2 in a corrugated form inside the bending direction is widened to be substantially the same pitch as F1 to correct the entire bend, and the fin width F2 before formation is 48 mm and the fin width F2 after formation is 47.5 mm. Incidentally, other effects and structure are the same as those of the first embodiment, so an explanation thereof is omitted.

The method thus used to correct the bend of the corrugated fin 2 can provide the following effects in addition to effects (1) and (2) of the first embodiment.

(5) For a composite heat exchanger 1 for motor vehicles, the condenser portion 21 and the radiator portion 22 are integrally formed next to each other to have different fin widths, and a bend of an entire corrugated fin 2 during a corrugating step is corrected thereafter by widening the wave pitch inside the bending direction to a predetermined width. Accordingly, bending can be further corrected and minimized, and the two portions 21 and 22 of the corrugated fin 2 can have different fin widths, thereby meeting diversified demands for performance.

Further, this corrugated fin 2 correcting device 4 used in combination with the first embodiment and the second embodiment can limit bending of the corrugated fin 2 with high precision, which can thus contribute to efficient manufacturing during a manufacturing step of composite heat exchanger 1 thereafter, and to increase of product precision of the composite heat exchanger 1.

As described above, the corrugated fin of the present invention has been explained based on the first embodiment and the second embodiment. However, the specific structure is not limited to these examples, and modification or addition of design will be tolerated without departing from the gist of the invention according to the respective claims.

For example, in the examples, the louvers are formed to be orthogonal to air passing through the corrugated fin, but the louvers may be formed to have an angle relative to air passing through the corrugated fin. In this case, a condenser side and a radiator side may have the same direction or a different direction, and may have the same angle or a different angle.

Further, when changing a wave pitch of the corrugated fin, the corrugated fin is passed through between rollers having a predetermined width in the examples, but the corrugated fin may be pressed to lower a wave height.

The entire contents of Japanese Patent Application 2002-309952 (filed Oct. 24, 2002) are incorporated herein by reference.

The present embodiments are to be considered in all respects as illustrative and not restrictive, and all changes which come within the meaning and range of equivalency of the claims are therefore intended to be embraced therein. The invention may be embodied in other specific forms without departing from the spirit or essential characteristics thereof.

What is claimed is:

1. A corrugated fin comprising:

a first corrugated fin portion having a first fin width corresponding to a first type of heat exchanger;

a second corrugated fin portion having a second fin width corresponding to a second type of heat exchanger, with said first and second corrugated fin portions being integrally adjacent one another, and with said first fin width being less than said second fin width;

a first louver on said first corrugated fin portion so as to extend corresponding to said first fin width, said first louver having first louver slats inclined in a first direction at a first predetermined angle; and a second louver on said second corrugated fin portion so as to extend corresponding to said second fin width, said second louver having second louver slats inclined in a second direction at a second predetermined angle, with said first direction being different from said second direction, wherein a processed amount per unit width of said second louver is less than a processed amount per unit width of said first louver so as to balance residual stress between said first and second corrugated fin portions and thereby prevent bending of the corrugated fin in its entirety.

2. The corrugated fin according to claim 1, wherein said second predetermined angle is less than said first predetermined angle.

3. The corrugated fin according to claim 2, wherein a pitch between adjacent ones of said second louver slats is less than a pitch between adjacent ones of said first louver slats.

4. The corrugated fin according to claim 3, wherein said first corrugated fin portion corresponds to an automotive condenser, and said second corrugated fin portion corresponds to an automotive radiator.

5. The corrugated fin according to claim 2, wherein said first corrugated fin portion corresponds to an automotive condenser, and said second corrugated fin portion corresponds to an automotive radiator.

6. The corrugated fin according to claim 1, wherein a pitch between adjacent ones of said second louver slats is less than a pitch between adjacent ones of said first louver slats.

7. The corrugated fin according to claim 6, wherein said first corrugated fin portion corresponds to an automotive condenser, and said second corrugated fin portion corresponds to an automotive radiator.

8. The corrugated fin according to claim 1, wherein said first corrugated fin portion corresponds to an automotive condenser, and said second corrugated fin portion corresponds to an automotive radiator.

9. A method of manufacturing a corrugated fin, comprising:

forming a first louver on a first corrugated fin portion so as to extend corresponding to a first fin width of said first corrugated fin portion, said first louver having first louver slats inclined in a first direction at a first predetermined angle, and said first fin width corresponding to a first type of heat exchanger; and forming a second louver on a second corrugated fin portion, integrally adjacent said first corrugated fin portion, so as to extend corresponding to a second fin width of said second corrugated fin portion, said second louver having second louver slats inclined in a second direction at a second predetermined angle, with said first direction being different from said second direction and said first fin width being less than said second fin width, and said second fin width corresponding to a second type of heat exchanger, wherein a processed amount per unit width of said second louver is less than a processed amount per unit width of said first louver so as to balance residual stress between said first and second corrugated fin portions and thereby prevent bending of the corrugated fin in its entirety.

10. The method according to claim 9, further comprising:

after forming said first and second louvers, correcting a bend of said first and second corrugated fin portions in their entirety by widening to a predetermined width a wave pitch inside a bending direction of said first and second corrugated fin portions.

11. The method according to claim 10, wherein correcting a bend of said first and second corrugated fin portions comprises passing said first and second corrugated fin portions between rollers, with a circumferential speed of one of said rollers positioned inside said bending direction being greater than a circumferential speed of one of said rollers positioned outside said bending direction.

12. The method according to claim 11, wherein said second predetermined angle is less than said first predetermined angle.

13. The method according to claim 9, further comprising:

after forming said first and second louvers, correcting a bend of said first and second corrugated fin portions by passing said first and second corrugated fin portions between rollers, with a circumferential speed of one of said rollers positioned inside a bending direction of said first and second corrugated fin portions being greater than a circumferential speed of one of said rollers positioned outside said bending direction.

14. The method according to claim 9, wherein said second predetermined angle is less than said first predetermined angle.

15. The method according to claim 14, wherein a pitch between adjacent ones of said second louver slats is less than a pitch between adjacent ones of said first louver slats.

16. The method according to claim 15, wherein said first corrugated fin portion corresponds to an automotive condenser, and said second corrugated fin portion corresponds to an automotive radiator.

17. The method according to claim 14, wherein said first corrugated fin portion corresponds to an automotive condenser, and said second corrugated fin portion corresponds to an automotive radiator.

18. The method according to claim 9, wherein a pitch between adjacent ones of said second louver slats is less than a pitch between adjacent ones of said first louver slats.

19. The method according to claim 18, wherein said first corrugated fin portion corresponds to an automotive condenser, and said second corrugated fin portion corresponds to an automotive radiator.

20. The method according to claim 9, wherein said first corrugated fin portion corresponds to an automotive condenser, and said second corrugated fin portion corresponds to an automotive radiator.

* * * * *